United States Patent [19]

Holt et al.

[11] 4,396,648

[45] Aug. 2, 1983

[54] PAPER COATING APPARATUS AND METHOD

[75] Inventors: Sherwood G. Holt, Biron; George H. Rasmussen, Wisconsin Rapids, both of Wis.

[73] Assignee: Consolidated Papers, Inc., Wisconsin Rapids, Wis.

[21] Appl. No.: 347,000

[22] Filed: Feb. 8, 1982

[51] Int. Cl.[3] ..... B05D 3/12; B05D 1/26; B05D 5/02

[52] U.S. Cl. ..... 427/356; 118/410; 118/413

[58] Field of Search ..... 118/608, 407, 410, 413, 118/411, 6; 427/356, 358

[56] References Cited

U.S. PATENT DOCUMENTS

| | | | |
|---|---|---|---|
| 2,933,061 | 4/1960 | Galer | 118/410 X |
| 3,151,353 | 10/1964 | Rodenacker | 118/410 X |
| 3,179,536 | 4/1965 | Martinek | 118/407 X |
| 3,227,136 | 1/1966 | Bartlett et al. | 118/410 |
| 3,304,910 | 2/1967 | Warner | 118/104 |
| 3,461,837 | 8/1969 | Dreher | 118/410 X |
| 3,496,012 | 2/1970 | Biorseth | 118/410 X |
| 3,526,536 | 9/1970 | Spengos et al. | 118/407 X |
| 3,533,833 | 10/1970 | Takahashi et al. | 118/410 X |
| 4,250,211 | 2/1981 | Damrau et al. | 427/356 |

*Primary Examiner*—John P. McIntosh

*Attorney, Agent, or Firm*—Gary, Juettner & Pyle

[57] ABSTRACT

Applicators for applying a film of coating material on a moving web of paper carried through an application zone include a chamber which receives coating material under pressure and directs the material through a narrow outlet orifice into the application zone, and a doctor blade which extends from a trailing side of the zone in contact with the web. The upper edge of a front wall of the chamber is closely spaced from the web to form, in conjunction with the pressurized coating material flowing from the orifice, a liquid seal at a forward end of the application zone, and seals are established at opposite side ends of the zone to allow development of a positive liquid pressure in the zone. In the various embodiments, rotating rolls located in the chamber, in the orifice, in the space between the upper edge of the front wall and the web and in both the space and the orifice serve to meter, homogenize and control the pressure of coating material in the application zone.

12 Claims, 5 Drawing Figures

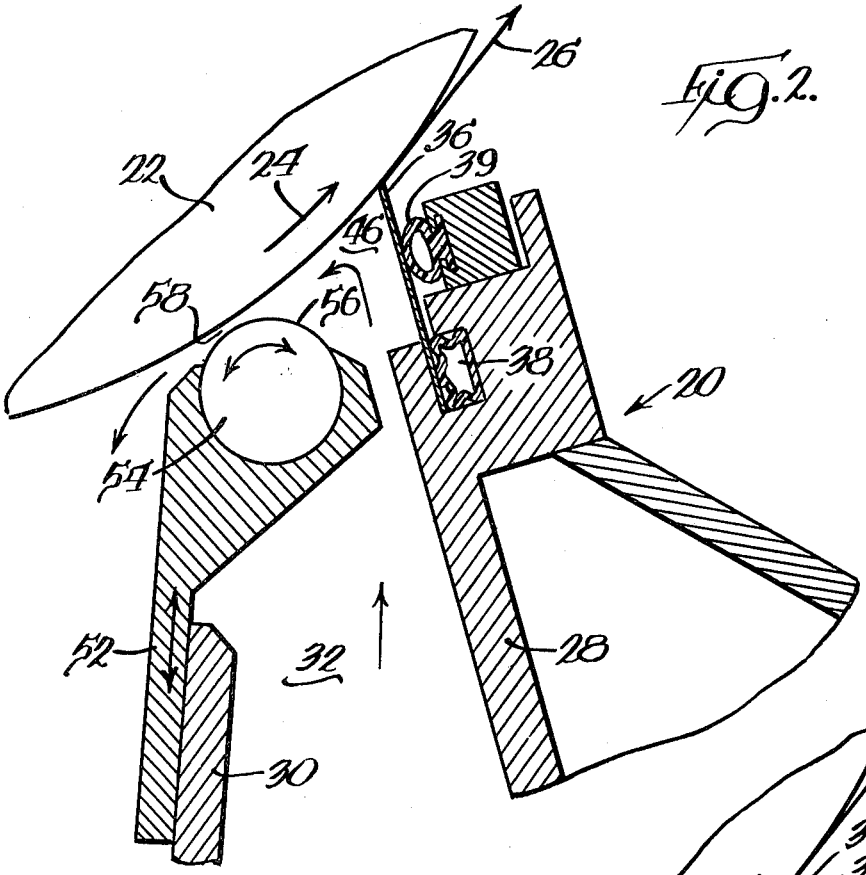
Fig. 2.
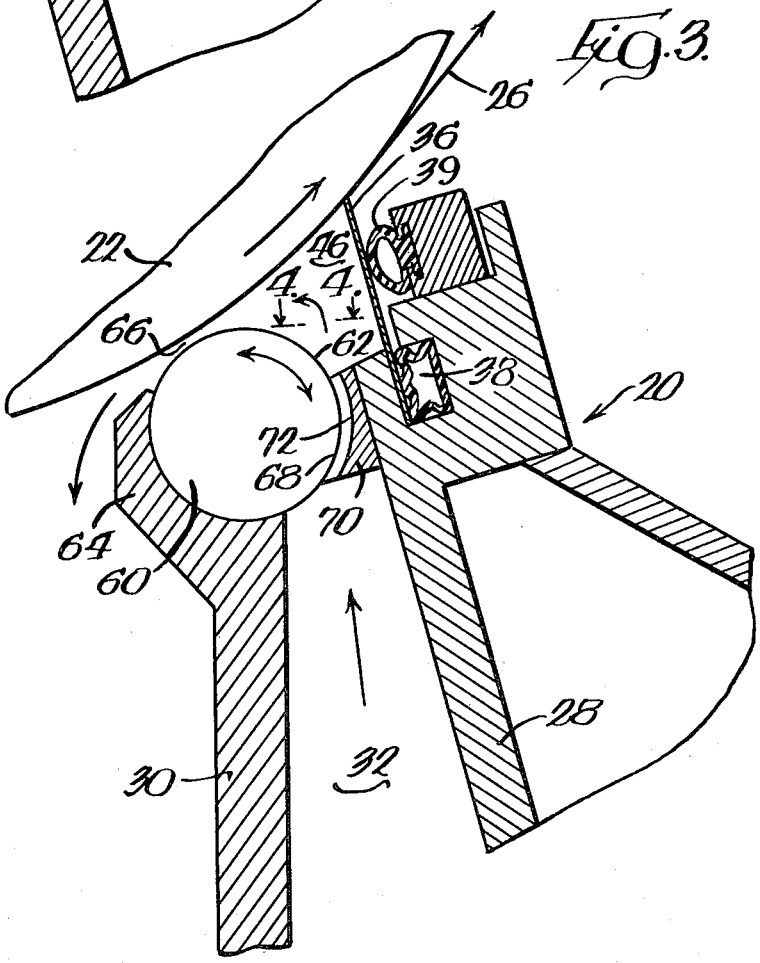
Fig. 3.
Fig. 4.
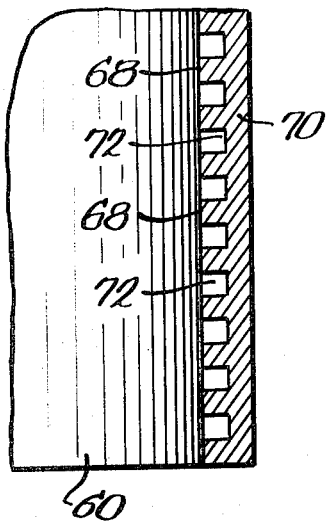

PAPER COATING APPARATUS AND METHOD

BACKGROUND OF THE INVENTION

The present invention relates to an apparatus for applying coating material on a moving web of paper, and in particular to coating apparatus of the trailing blade type wherein accurate control over flow of material to and pressure of material in an application zone, and treatment of the material to homogenize the same, is accomplished in novel and improved manners.

Conventional coaters of the trailing blade type include means for applying coating material to a paper web that is usually supported and carried by a resilient backing roll, together with a flexible coater or doctor blade located on the trailing side of the applicator, which serves to doctor or level the applied coating. In general, an excess of coating material is applied on the web and the coater blade then meters or removes the excess while uniformly spreading the coating onto the web surface.

In recent years it has become desirable to produce papers having a minimum amount of coating. To achieve low coat weights with conventional trailing blade equipment it is necessary to increase the pressure of the coater blade against the web, which results in a high rate of wear of the blade the necessitates more frequent blade replacement. High blade pressure also increases the possibility of web breaks and streaking caused by foreign particles caught between the blade and web.

Conventional coaters employ a relatively long dwell or soak time, which is the time interval between initial application and final blading of the coating. As a result, the water portion of the coating composition, as well as some of the water soluble or dispersible materials contained therein, migrate into the moving web at a more rapid rate than the pigment and eventually cause an undesirable imbalance in the coating constituents and their rheological properties. Long soak periods are also incompatible with the application of successive web coats without intervening drying, because the successive coats tend to migrate into and contaminate the previous coat.

To overcome the disadvantages of prior applicators and to apply lightweight coatings on paper, there has been developed a short dwell time applicator as disclosed in U.S. Pat. No. 4,250,211, issued to Damrau et al. and assigned to the assignee of the present invention. In that applicator, coating material is introduced in excess into a relatively narrow application zone for being applied on a web of paper carried therethrough. A forward wall of the applicator defines a relatively narrow gap with the web at the upstream end of the zone, and excess material in the zone overflows through the gap and forms therein a liquid seal, so that coating material in the zone and as applied to the web is maintained under pressure. The speed of the web is adjusted for a relatively short dwell time, and a flexible coater blade doctors the web at the downstream end of the zone, thereby removing excess material from the web and at the same time uniformly spreading the material on the web. In consequence of the short dwell time of the pressurized application of coating material on the web, an appropriate yet lightweight amount of coating may be applied without need for high blade pressures.

The coating material which flows through the gap between the forward wall and the web to form the liquid seal is returned to the supply for recirculation, which prevents stagnation and hardening of the material in the application zone. However, despite recirculation and although new coating material is added to the supply to replace that applied on the web, with the passage of time the viscosity of the material changes and interferes with application of a uniform coating on the web.

In addition to the viscosity of the coating material affecting the uniformity of coating applied on the web, also of importance to the quality and quantity of coating is the pressure of the material within the application zone. The pressure in the zone is influenced by the pressure of the material within the chamber, along with the size of the metering slot between the chamber and zone and of the orifice between the front wall and the web. Therefore, the sizes of the metering slot and orifice are adjustable and the pressure of coating material introduced into the chamber is controllable to control the pressure in the zone. However, while the sizes of the orifice and metering slot are not ordinarily subject to to change once adjusted, it often happens that changes occur in the pressure of coating material introduced into the chamber, and slight variations in the pressure cause variations in the pressure in the application zone and affect the coating rate, either by causing too much or too little coating material to be applied on the paper.

SUMMARY OF THE INVENTION

The short dwell time applicators or coaters of the present invention constitute improvements over the aforesaid prior applicators, in that an enclosed pressure reservoir or coating material application zone is established between the coating applicator, the blade and the supported web, with a liquid seal being formed at the forward end of the zone and rotating rolls being used to meter the amount of coating material flowed into the zone to control the pressure of material therein and to homogenize the material to improve the viscosity thereof.

The applicators may be used with a backing roll carrying a web of paper, or a pair of applicators may be arranged on opposite sides of the web so that a web supporting roll is not needed. The applicators include a chamber which receives a supply of coating material under pressure and directs the material through a narrow metering slot into the application zone, and a doctor blade at the trailing end of the zone extending into contact with the web. The upper edge of the chamber front wall is closely spaced from the supported web and doctor blade so as to form, in conjunction with the pressurized liquid flowing from the metering slot, a liquid seal with the web. Means are provided for sealing the sides of the application zone to the web to allow establishment of positive liquid pressure in the zone. The applicator forms an enclosed pressure reservoir of coating material with the web to apply a continuous narrow strip or band of pressurized coating material on the web, which enables application of low coat weights.

Excess material overflowing through the forward gap to form a liquid seal is collected for return to the supply of coating material and recirculation. Although recirculation agitates the material to prevent stagnation and hardening of the material in the application zone, and while fresh material is added to the supply to replace that applied on the web, some changes nevertheless occurs in the viscosity and uniformity of the material. At the same time, although attempts are made to maintain as uniform as possible the pressure of coating material introduced into the chamber, slight changes in pressure occasionally occur and affect the pressure of the material in the application zone.

To overcome the foregoing disadvantages, in accordance with one embodiment of the invention a rotating pump roll in and extending coextensively with the chamber is sealed on one side with the chamber and rotates in close proximity to a concave chamber wall portion on an opposite side. Coating material introduced at an inlet to the chamber on one side of the roll flows in a narrow passage defined between the roll and the concave wall portion to the application zone. Rotation of the roll homogenizes and improves the viscosity of the material as it moves therepast, and the rate of rotation influences the volume flow of material to and therefore the pressure of material in the application zone.

In another embodiment, a rotating roll carried in the front wall of the chamber extends partially into the chamber to define between its exposed surface and the chamber rear wall the metering slot between the chamber and application zone. The roll may be rotated at variable speeds in either direction, thereby to homogenize coating material moving therepast and to control the amount of material introduced into, and therefore the pressure of material in, the application zone.

In a further embodiment, a rotating roll extending transversely of the chamber is carried by the upper end of the chamber front wall, and defines between its exposed surface and the web the orifice through which coating material flows to form the liquid seal. Rotation of the roll homogenizes coating material flowing through the orifice, with the rate and direction of rotation influencing the volume flow rate of material out of, and therefore the pressure of material in, the application zone.

The invention also contemplates combining the features of the two immediately aforementioned embodiments, thereby to expose the surface of a single rotating roll to coating material in the metering slot, orifice and application zone. The roll is supported at the upper end of the chamber front wall, such that an exposed surface thereof forms one side of the metering slot and one side of the orifice. A member on the chamber rear wall opposite from the roll engages the roll with a surface thereof to hold the roll on the front wall, and a plurality of spaced channels in the surface extend between the chamber and application zone and define metering slots for flow of coating material into the zone. Rotation of the roll thus agitates or homogenizes coating material in the metering slots, application zone and orifice, with the direction and rate of rotation controlling the volume flow rate of material to and therefore the pressure of material in the zone.

The foregoing and other advantages and features of the invention will become apparent upon a consideration of the following detailed description, when taken in conjunction with the accompanying drawings.

BRIEF DESCRIPTION OF THE DRAWINGS

FIG. 2 illustrates an applicator, which in accordance with another embodiment has a rotating roll carried by the upper end of the chamber front wall to define with the web an overflow orifice in which a liquid seal is formed and to homogenize and meter coating material overflowing from the application zone;

FIG. 3 shows an applicator in accordance with a third embodiment of the invention, wherein a rotating roll carried at the upper end of the chamber front wall defines both the metering slot and the orifice to homogenize and meter coating material both as it flows into and as it flows out of the application zone;

FIG. 4 is a cross sectional view taken substantially along the lines 4—4 of FIG. 3.

DETAILED DESCRIPTION

Figure 1:
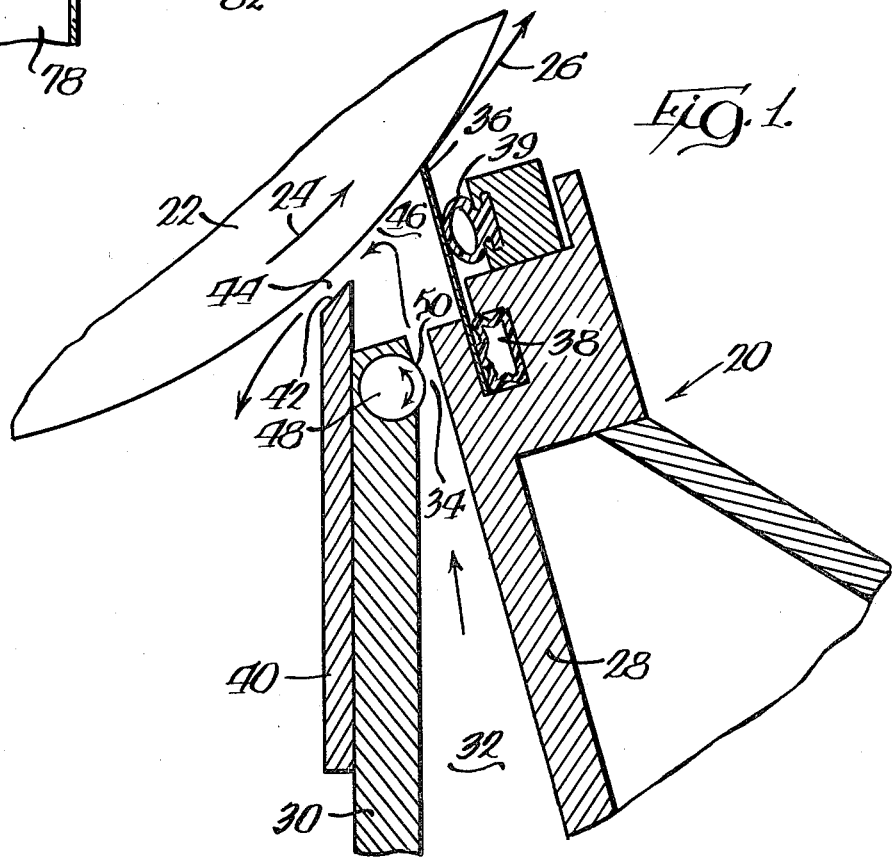
FIG. 1 illustrates a short dwell time applicator for applying a coating to a moving web of paper, wherein in accordance with one embodiment of the invention a rotating roll mounted in a front wall of a coating material supply chamber defines with a rear wall of the chamber a narrow metering slot and homogenizes and meters coating material flowing through the slot into an application zone.

Referring to FIG. 1, there is shown an applicator or coater portion of a paper coating machine configured in accordance with the teachings of one embodiment of the invention. The applicator comprises a main beam, indicated generally at 20, extending parallel to and coextensively with a movable support or backing roll 22 which rotates in the direction shown by an arrow 24 and supports a web of paper 26 during its travel through an application zone. The beam has rear and front walls 28 and 30 forming a chamber 32 therebetween for reception of liquid coating material under pressure from a source of material (not shown), and the walls converge upwardly toward one another and define a metering slot 34 which extends upwardly adjacent to and facing the web support surface of the roll 22. Although not shown, the front wall is pivotally mounted relative to the rear wall to permit the chamber 32 to be opened for cleaning and also to adjust the width of the metering slot 34.

A flexible doctor or coater blade 36 at the downstream end of the application zone is held against a rearward surface of the wall 28 by a pneumatic tube 38 which is expandable by the introduction of fluid under pressure therein to press against the blade. The coater blade extends beyond the metering slot 34 and is urged into engagement with the web supported on the roll by a pneumatic tube 39 to meter and level the coating applied on the surface of the web. An orifice plate 40 is mounted and vertically adjustable on the front wall 30, and converges toward the roll supported web and the coater blade. The orifice plate has a free edge 42 which is juxtaposed to but spaced slightly from the web, such that an orifice, gap or space 44 between the edge and the web is relatively small and less than one inch.

At the two ends of the coater, the spaces between the coater blade 36 and the orifice plate 40 are sealed off in a manner known in the art by flexible edge dams (not shown), which seal with the upper edges of the walls 28 and 30, the blade 36, the orifice plate 40 and the roll supported web 26, thereby to define a coating material application zone 46 downstream from the chamber 32 and the metering slot 34.

In operation of the applicator thus far described, coating liquid is introduced into the chamber 32 under sufficient pressure and in sufficient quantity to completely fill the chamber, the metering slot 34 and the application zone 46 defined by the doctor blade 36, the orifice plate 40 and the end dams to cause a continuous, copious flow of coating material reversely of the direction of web travel through the narrow orifice 44. This forms a liquid seal at the forward end of the application zone and causes the coating liquid to be applied to the web in a very narrow transverse band under a constant positive pressure. The copious excess of coating liquid that flows through the orifice reversely of the direction of web travel forms a non-abrasive liquid seal with the web at the upstream or forward edge of the coating application zone; causes the coating liquid in the zone to be maintained under pressure and to be applied to the web under pressure; seals off the forward edge of the zone against entry of air and foreign matter; strips air from the high speed web and prevents such air from causing streaks or skips in the coating on the web; and causes the downstream coater blade 36 to doctor the coating liquid while the liquid is held under pressure.

The applicator is generally referred to as a short dwell time applicator. That is, to avoid saturation of the web with coating material, thereby to prevent the water portion of the coating composition as well as the water solution or dispersible materials contained therein from migrating into the web at a more rapid rate than the pigment, the web is exposed to the coating material in the application zone for only a relatively short time. To this end, the width of the application zone in the direction of web travel, as well as the speed of travel of the web through the zone, are controlled to provide a relatively short dwell time of the web within the zone.

The coating applicator thus far described is of the type disclosed in detail in aforementioned U.S. Pat. No. 4,250,211, assigned to the assignee of the present invention, and the teachings of which are specifically incorporated herein by reference. For a more specific description of the applicator, reference is made to said patent.

The sizes of the metering slot 34 and of the orifice 44 are critical to operation of the coating applicator, since in combination with the pressure of coating material introduced into the chamber 32 they strongly influence the pressure of the material within the application zone 46, and therefore the quality and quantity of coating applied onto the paper web. As previously described, the wall 30 is movable toward and away from the wall 28 to control the size of the metering slot, and the orifice plate 40 is vertically adjustable on the wall 30 to control the size of the orifice. The orifice is ordinarily made to be relatively small, so that coating material flowing therethrough from the application zone forms a fluid seal for the zone, whereby material in the zone is maintained under pressure for application on the web. The flow of material through the orifice prevents stagnation and hardening of the material in the application zone, and is returned to the supply for recirculation.

Once adjusted, the sizes of the metering slot 34 and orifice 44 ordinarily remain constant. However, it is difficult to maintain a constant pressure of the coating material delivered to the chamber 32, and even slight variations in the pressure affect the coating rate, either by causing too much or too little material to be applied to the paper. Accordingly, the embodiment of invention shown in FIG. 1 contemplates a metering roll 48 rotatably mounted in an opening formed in the upper end of the wall 30, such that a portion of a surface 50 of the roll extends inwardly of the wall. The roll, which may be on the order of ½ inch to 1½ inches in diameter, extends parallel to and coextensively with the chamber, and with the rear wall 28 defines the metering slot 34. Although not shown, a conventional motor means rotates the roll at a controlled rate of from about 30–300 rpm in either direction to assist or impede a flow of coating material through the metering slot. That is, since the surface 50 of the roll is exposed to the flow of coating material in the metering slot, rotation of the roll in a counterclockwise direction assists, and in the clockwise direction impedes, the flow of material through the slot, with the rate of rotation determining the degree to which the flow is assisted or impeded.

Consequently, the roll provides an additional measure of control over the rate at which coating material is delivered to, and therefore the pressure of material within, the application zone 46. At the same time, the rotating surface 50 of the roll works or shears the coating material immediately prior to its introduction into the application zone, which homogenizes the material and improves its viscosity so that improvements in the quality of coating applied on the web are obtained.

In the embodiment of applicator shown in FIG. 2, a modified orifice plate 52 is vertically adjustable on the front wall 30, and rotatably carries a metering roll 54 in an opening in an upper end thereof. The roll extends parallel to and coextensively with the application zone 46, and a portion of a surface 56 of the roll extends from the upper surface of the orifice plate and is exposed to coating material in the application zone 46 and to material flowing from the zone through a relatively narrow orifice 58 defined between the roll and the paper web. A liquid seal is formed in the orifice, and although not shown, a conventional motor means rotates the rod in either direction at a controlled rate of rotation.

Coating material in the application zone 46 and orifice 58 is controlled by the metering roll 54 to provide a uniform flow of material across the width of the paper web. It has been found that the roll provides a smooth and controlled return flow of coating material, and that rotation of the roll agitates and homogenizes the material to improve its viscosity and assists in preventing air from entering the application zone. Also, the direction and rate of rotation of the roll may be controlled to either assist or impede a flow of coating material from the zone through the orifice, thereby to provide a measure of control over the pressure of material in the zone, with rotation of the rod in a clockwise direction impeding a flow to increase the pressure and in a counterclockwise direction assisting a flow to decrease the pressure.

The embodiment of applicator in FIGS. 3 and 4 combines the features of the above two embodiments, and includes a rotatable metering cylinder or roll 60 having a surface 62 which is exposed both to the inlet and outlet sides of the application zone 46, as well as to the zone itself. The roll is rotatably supported in a concave holder 64 at the upper end of the front wall 30, and at the outlet from the zone the surface 62 forms with the web a narrow orifice 66 in which a liquid seal is formed. The cylinder is maintained in the holder by a curved surface 68 of a member 70 mounted on the wall 28, and the surface is provided with spaced channels 72 which extend between the chamber 32 and the application zone 46, are approximately ¼ inch wide and provide about a 50 percent open area through the member. The channels define metering slots between the chamber and the application zone, and rotation of the roll in either direction at a controlled rate by any suitable means homogenizes and shears the coating material in the metering slots, orifice and zone, thereby to improve the viscosity of the material and the uniformity of its application onto the web.

The metering roll 60 also provides two additional advantages. In a first instance, the roll itself defines, with the paper web, the outlet orifice from the application zone, thus controlling overflow from and providing a fluid seal to the zone. It has been found that use of a rotating cylinder for an outlet orifice gives a particularly smooth and controlled character to the excess coating material returned to the main supply. A second advantage resides in the fact that the speed and direction of rotation of the roll affords a degree of control over the rate of delivery of coating material from the chamber 32 to the application zone, and from the zone through the orifice 66, and therefore over the pressure of material in the zone. Rotation of the cylinder in a counterclockwise direction assists a flow of material into and from the zone, and in the counterclockwise direction impedes the flow, with the rate of rotation determining the degree to which the flow is assisted or impeded.

Figure 5:
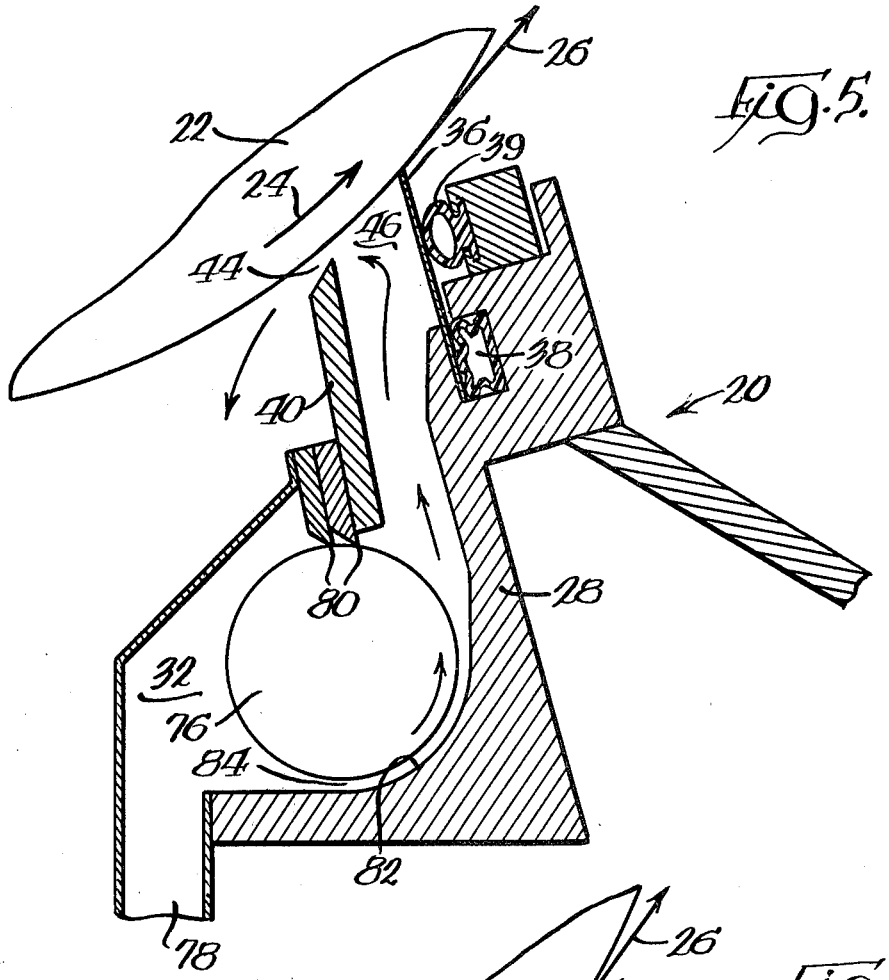
FIG. 5 illustrates an applicator which has a rotating roll in the chamber thereof for pumping, metering and homogenizing coating material introduced into the application zone.

In the applicator illustrates in FIG. 5, a pump or metering roll 76 is rotatably mounted in the chamber 32 intermediate a material inlet 78 to the chamber and the outlet therefrom. The roll extends parallel to and coextensively with the chamber, and is rotatable at a controlled rate in the direction shown by any suitable means. The roll is sealed at its upper end to one side of the chamber by a pair of seals 80 and is slightly spaced from a concave surface 82 of the wall 28 to define therewith a narrow passage 84 between the inlet to and the outlet from the chamber.

The arrangement is such that the roll, upon rotation in the direction shown, pumps coating material from the chamber inlet to the outlet, and works and shears the material to homogenize it immediately prior to its introduction into the application zone. The roll supplies a uniform, mixed and metered supply of coating material into and across the entire width of the application zone. As a result, there are no nonuniformities in the supply of material to the zone, which otherwise may occur with conventional applicators wherein a manifold is provided in the chamber in an attempt to evenly distribute coating material introduced therein. The flow rate of material into the application zone is controlled by the clearance between the roll and the wall surface 82, as well as by the rotational rate of the roll and the characteristics of the coating material.

The invention thus provides improved means for treating or homogenizing coating material for a paper coater and for controlling the rate of flow of material into and out of an application zone, thereby to control the pressure of material in the zone for very accurate and uniform pressure application of coating material on a web. Although not specifically illustrated, it is understood that in use of the various embodiments of invention a pressure transducer would be positioned in the application zone to sense the pressure of coating material therein, with the output from the transducer being used to control the motor means for rotating the rolls, thereby to control the direction and speed of rotation of the rolls in a manner to maintain the pressure at a selected and constant value.

While embodiments of the invention have been described in detail, various modifications and other embodiments thereof may be devised by one skilled in the art without departing from the spirit and scope of the invention, as defined in the appended claims.

What is claimed is:

1. An improved method of applying coating liquid to a moving web of paper, comprising the steps of applying coating liquid under pressure to one surface of a moving web of paper carried through an application zone having spaced front and rear edges and laterally spaced side edges; forming and maintaining a reservoir of coating liquid under pressure on the web in the application zone by introducing coating liquid under pressure into a chamber having front and rear walls the upper ends of which define the front and rear edges of the zone and an opening to the zone, and flowing the coating liquid in the chamber through the opening and into the zone; doctoring the coating liquid on the web at the rear edge of the zone; maintaining the coating liquid in the application zone under pressure by substantially sealing the side edges of the zone and by establishing a liquid seal in an orifice defined between the web and the front edge of the zone which extends substantially laterally across the web; and continuously flowing coating liquid under pressure into the application zone to substantially completely and continuously fill the orifice with coating liquid for forming the liquid seal and for sealing off the front edge of the zone, wherein the improvement comprises the step of metering and treating the coating liquid by flowing the coating liquid through a narrow gap defined between a portion of a surface of an elongate rotating roll extending substantially laterally across the web and at least one of a surface of a wall to interior of the chamber and the surface of the web at the orifice, thereby to expose the flow of coating liquid to the moving surface of the rotating roll in the gap to control or meter its flow rate and therefore to control the pressure of coating liquid in the application zone and to homogenize the coating liquid to improve its viscosity and therefore the quality of coating applied on the web.

2. A method as in claim 1, including the step of controlling the rate and direction of rotation of the roll in either direction so that the surface of the roll in the gap moves at a selected speed either in the same direction as or against the direction of flow of coating liquid therethrough to control the flow rate of coating liquid through the gap and thereby to maintain a substantially constant flow rate of coating liquid into and a substantially constant pressure of coating liquid in the application zone despite variation in the pressure at which coating liquid is introduced into the chamber.

3. A method as in claim 1 or 2, wherein said metering and treating step comprises rotatably mounting the roll in the chamber intermediate the chamber opening and the point of introduction of coating liquid therein to define the gap between the surface portion of the roll and an arcuate inner surface portion of one of the chamber front and rear walls, and forming a seal between the roll and the other wall so that coating liquid introduced into the chamber flows through the gap for being metered and treated.

4. A method as in claim 1 or 2, wherein said metering and treating step comprises rotatably mounting the roll interior of the chamber in one of the chamber front and rear walls toward the chamber opening to extend the surface portion of the roll away from the one wall and toward the other wall to define the gap between the portion and the other wall, whereby coating liquid introduced into the chamber flows through the gap for being metered and treated.

5. A method as in claim 1 or 2, wherein said metering and treating step comprises rotatably mounting the roll in the front edge of the front wall to extend the surface portion of the roll away from the edge and toward the web to define the gap between the portion and the surface of the web, whereby the gap and the orifice are the same and coating liquid flowing through the gap forms the liquid seal and is metered and treated.

6. A method as in claim 1 or 2, wherein said metering and treating step comprises rotatably mounting the roll in the upper end of the front wall to extend the surface portion of the roll away from the upper end and toward the web to define a first gap between the portion and the surface of the web, whereby the first gap and orifice are the same, toward the upper end of the rear wall in proximity with the chamber opening to define a second gap between the portion and the rear wall, and toward and into the application zone, whereby coating liquid introduced into the chamber is metered and treated as it flows through the second gap, the application zone and the first gap.

7. An improved apparatus for applying coating liquid under pressure to one surface of a moving web of paper carried through an application zone, wherein the apparatus is of the type comprising a chamber having front and rear walls, side edges and an outlet slot between said walls and edges opening into and extending substantially transversely across said application zone, said front wall including a front edge spaced from the web and defining therewith an orifice; means for substantially sealing to the web side edges of said application zone and said side edges of said chamber; a doctor blade at a rearward end of said application zone for metering and leveling coating liquid on the web, said application zone being defined between said front edge and said doctor blade; and means for continuously delivering coating liquid under pressure to said chamber, through said outlet slot and into said application zone for causing coating liquid under pressure to substantially completely and continuously fill said application zone and said orifice to form a liquid seal at a forward end of said zone, said liquid seal extending substantially continuously across the width of the web and sealing off the forward end of said application zone for maintaining the pressure of the coating liquid in said zone, wherein the improvement comprises an elongate metering and treating roll; means for rotatably mounting said roll downstream of the point of introduction of coating liquid into said chamber to define a narrow gap between a portion of a surface of said roll and at least one of a surface of a wall to interior of said chamber and the surface of the web at said orifice, said roll extending substantially laterally across the web; and means for rotating said roll, so that coating liquid delivered to said chamber flows through said gap and is exposed to said surface portion of said rotating roll therein for being metered to control its flow rate and therefore the pressure of coating liquid in said application zone and for being treated to homogenize it and improve its viscosity.

8. Apparatus as in claim 7, wherein said means for rotating includes means for controlling the direction and rate of rotation of said roll in either direction so that the surface of said roll in said gap moves at a selected speed either in the same direction as or against the direction of flow of coating liquid therethrough to control the flow rate of coating liquid through said gap and thereby to maintain a substantially constant flow rate of coating liquid into and a substantially constant pressure of coating liquid in said application zone despite variations in the pressure at which coating liquid is introduced into said chamber.

9. Apparatus as in claim 7 or 8, wherein one of said chamber front and rear walls has an inner arcuate surface portion, and said means for mounting rotatably mounts said roll in and along said chamber intermediate the point of delivery of coating liquid therein and said outlet slot to define said gap between said surface portion of said roll and said arcuate surface portion of said one wall, and including means for sealing said roll to the other wall so that coating liquid delivered to said chamber flows through said gap for being metered and treated.

10. Apparatus as in claim 7 or 8, wherein said means for mounting rotatably mounts said roll in said chamber in and along one of said chamber front and rear walls toward said outlet slot to extend said surface portion of said roll away from said one wall and toward the other wall to define said gap therewith, whereby coating material delivered to said chamber flows through said gap for being metered and treated.

11. Apparatus as in claim 7 or 8, wherein said means for mounting rotatably mounts said roll in and along said front edge of said front wall to extend said surface portion of said roll away from said front edge and toward the surface of the web to define said gap therewith, whereby said gap and said orifice are the same and coating liquid flowing through said gap and forming said liquid seal is metered and treated.

12. Apparatus as in claim 7 or 8, wherein said means for mounting rotatably mounts said roll in and along said front edge of said front wall to extend said surface portion of said roll away from said front edge and toward the surface of the web to define said gap therewith, whereby said gap and said orifice are the same, toward an upper inner surface of said chamber rear wall in proximity to said outlet slot to define a second gap therewith, and toward and into said application zone, whereby coating liquid delivered to said chamber is metered and treated as it flows through said second gap, said application zone and said orifice.

* * * * *